US010145521B1

(12) United States Patent
Xu et al.

(10) Patent No.: US 10,145,521 B1
(45) Date of Patent: Dec. 4, 2018

(54) LED STRIP-SHAPED LAMP WITH A CONNECTING STRUCTURE

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Bozhang Xu, Zhejiang (CN); Wen Wang, Zhejiang (CN); Zhiming Wang, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 15/934,349

(22) Filed: Mar. 23, 2018

(30) Foreign Application Priority Data

May 18, 2017 (CN) ..... 2017 1 0353964

(51) Int. Cl.
*F21S 4/20* (2016.01)
*F21V 15/01* (2006.01)
*F21V 23/06* (2006.01)

(52) U.S. Cl.
CPC ..... *F21S 4/20* (2016.01); *F21V 15/01* (2013.01); *F21V 23/06* (2013.01)

(58) Field of Classification Search
CPC ..... F21S 4/20; F21V 23/06; F21V 15/01
See application file for complete search history.

(56) References Cited

U.S. PATENT DOCUMENTS

2002/0089307 A1* 7/2002 Yang ..... G06F 1/26 320/116
2014/0125232 A1* 5/2014 Griffiths ..... F21S 2/005 315/154
2014/0328054 A1* 11/2014 Andersen ..... F21L 4/00 362/202
2017/0030561 A1* 2/2017 Dix ..... F21S 2/005

* cited by examiner

*Primary Examiner* — David V Bruce
(74) *Attorney, Agent, or Firm* — Wang Law Firm, Inc.

(57) ABSTRACT

An LED strip-shaped lamp with a connecting structure includes a first lamp housing, a plug disposed on the first lamp housing, a second lamp housing coupled with the first lamp housing, and a socket on the second lamp housing coupled to the plug. The plug includes a first magnet disposed at an end of the first lamp housing and a first electrical connector fixed in the first pad. The socket includes a second magnet at an end of the second lamp housing and a second electrical connector fixed in the second pad. When the magnets are coupled, the first and the second electrical connector are coupled to connect electrically. The magnets used in the connecting structure of the LED strip-shaped lamp of the present invention can be used as a structure for connecting the first and second lamp housing so as to simplify the connection of the strip-shaped lamps.

10 Claims, 2 Drawing Sheets

LED STRIP-SHAPED LAMP WITH A CONNECTING STRUCTURE

CROSS-REFERENCE TO A RELATED APPLICATION

This application claims priority to a Chinese Patent Application No. CN 201710353964.8, filed on May 18, 2017.

FIELD OF THE TECHNOLOGY

The present invention relates to the lighting equipment field, with particular emphasis on an LED strip-shaped lamp with a connecting structure.

BACKGROUND

In the context of energy saving and environmental protection, LED lamps are more and more used in the field of home lighting and commercial lighting because of high light output efficiency and good condenser performance. In places such as exhibition halls, jewelry stores, museums, supermarkets, some home lighting, such as large villas. With the extensive use of LED lamps, especially strip-shaped lamps, the lighting in these homes or commercial areas is brought closer to the real needs of users.

However, due to the structural characteristics of the strip-shaped lamps, ie, the strip-shaped structure, and the size of the place where the strip-shaped lamps are used is uncertain. Therefore, when installing the strip-shaped lamps, the strip-shaped lamps with different lengths need to be connected. Installation convenience of the strip-shaped lamps with different lengths or the same length will be one of the key points of the design of the strip-shaped lamps. In the meantime, when one or more of the strip-shaped lamps with different lengths need to be replaced if they are damaged, the entire lamps need to be disassembled then the damaged lamps can be disassembled. The process results in a waste of working hours and increase costs.

SUMMARY OF THE INVENTION

Therefore, it is necessary to provide an LED strip-shaped lamp with a connecting structure.

An LED strip-shaped lamp with a connecting structure, comprising: a first lamp housing, a plug disposed on the first lamp housing, a second lamp housing coupled with the first lamp housing, a socket on the second lamp housing and coupled to the plug; the plug comprising a first magnet disposed at an end of the first lamp housing and a first pad coupled within the first lamp housing, a first electrical connector fixed in the first pad; the first pad sandwiched between the first lamp housing and the first magnet; the socket comprising a second magnet disposed at an end of the second lamp housing and a second electrical connector fixed in the second pad, a second electrical connector fixed in the second pad; the second pad sandwiched between the second lamp housing and the second magnet; The first magnet and the second magnet attracting each other to couple the first lamp housing and the second lamp housing; when the first and second magnets are coupled, the first electrical connector and the second electrical connector being coupled to each other to connect electrically.

Further, the first electrical connector is a contact piece, the second electrical connector is a elastic contactor, attraction force of the first and second magnets is greater than elastic force of the elastic contactor against the contact piece.

Further, the LED strip-shaped lamp comprises two circuit boards respectively disposed in the first lamp housing and the second lamp housing, and the two circuit boards are respectively electrically connected with the contact piece and the elastic contactor.

Further, the elastic contactor comprises a blind barrel closed at one end, an elastic member filled in the blind barrel, and a contactor hooked on the open end of the blind barrel.

Further, the elastic contactor is made of a conductive material, the socket further comprises a spacer ring disposed between the elastic contactor and the second magnet, the spacer ring is made of insulating material.

Further, an end of the blind barrel has a flange, the flange is sandwiched between the spacer ring and the second pad, and an end of the spacer ring comprises a flange ring sandwiched between the flange and the second magnet.

Further, the plug further comprises a C-shaped clamping spring sandwiched between the first magnet and the contact piece to fix the relative position between the contact piece and the first pad.

Further, cross-sectional shapes of the first and second magnets respectively are the same as that of the first lamp housing and the second lamp housing, and the first and second magnets respectively open a through hole along the central axis to facilitate passing the magnetic flux.

Further, the first electrical connector is a socket hole, the second electrical connector is a pin, when the first and second magnets are coupled together, the pin is inserted in the socket hole to establish electrical connections.

Further, the first and second pads are made of insulating material.

Compared with the prior art, the first and second magnets used in the connecting structure of the LED strip-shaped lamp of the present invention can be used as a structure for connecting the first lamp housing and the second lamp housing so as to simplify the connection of the plurality of strip-shaped lamps. The connecting structure also provides a clamping force for coupling the first lamp housing and the second lamp housing. Due to the attractive force of the first and second magnets, the first lamp housing and the second lamp housing can be made to have no mating space without deformation in the connection portion, which may affect the appearance.

DETAILED DESCRIPTION OF THE DRAWINGS

The drawings described herein are intended to promote a further understanding of the present invention, as follows.

DESCRIPTION OF THE PREFERRED EMBODIMENTS

The present application is illustrated by way of the following detailed description based on of the accompanying drawings. It should be noted that illustration to the embodiment in this application is not intended to limit the invention.

Figure 1:
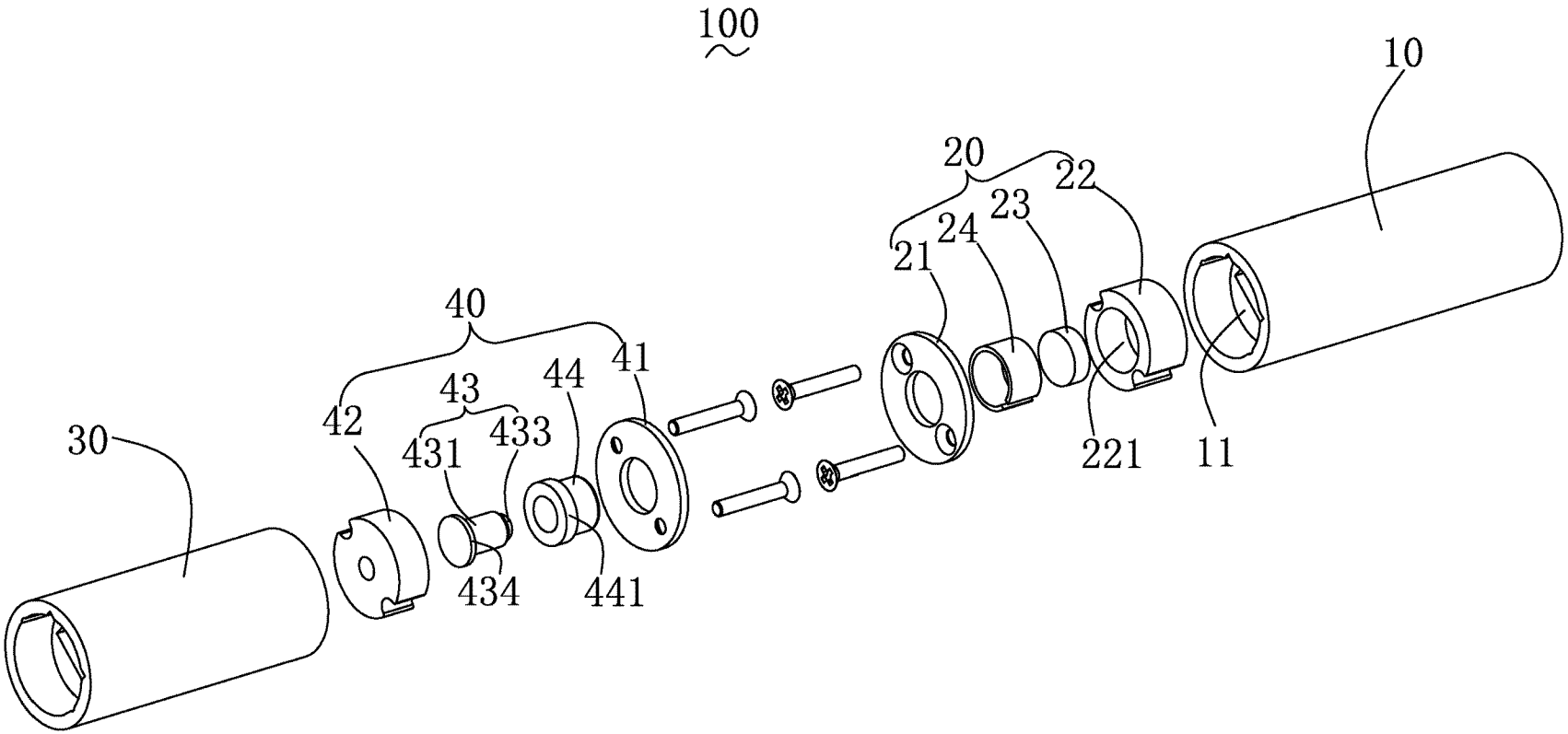
FIG. 1 is a structure diagram of an LED strip-shaped lamp with a connecting structure provided by the present invention.
Figure 2:
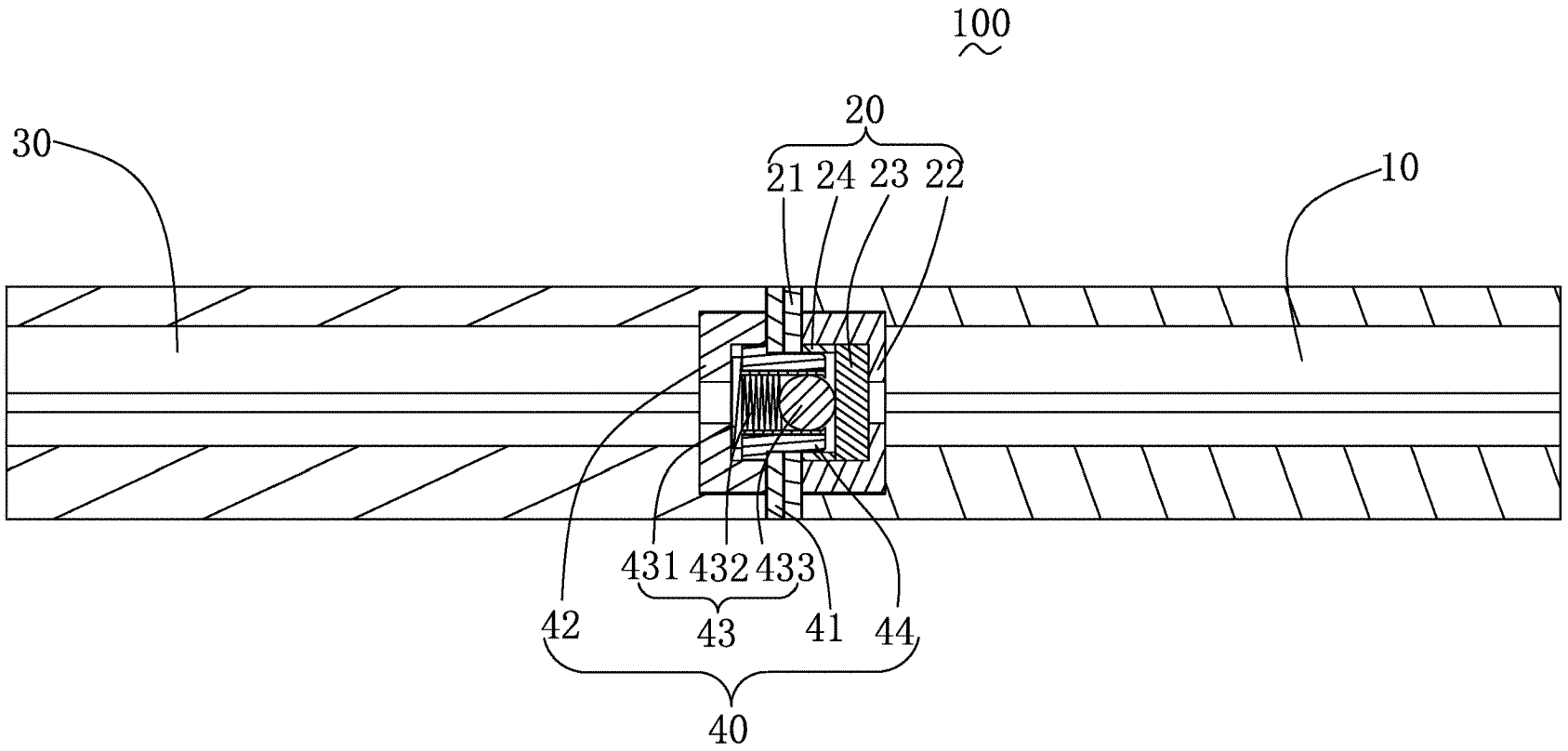
FIG. 2 is a section view of the LED strip-shaped lamp with a connecting structure provided by the present invention of FIG. 1.

Referring to FIG. 1 to FIG. 2, FIG. 1 is a structure diagram of an LED strip-shaped lamp 100 with a connecting structure provided by the present invention. The LED strip-shaped lamp 100 with a connecting structure comprises a first lamp housing 100, a plug 20 disposed on the first lamp housing 10, a second lamp housing 30 coupled with the first lamp housing 10, a socket 40 on the second lamp housing 30 and coupled to the plug 20. It can be understood that the LED strip-shaped lamp 100 with a connecting structure further comprises other functional modules such as a light-emitting module, a light distribution module accommodated in the first and second lamp housings 10, 30 and a circuit board disposed in the first and second lamp housings 10 and 30 respectively and the like, which are used as common functional modules of the LED lamp and will not be described in detail herein.

As a uniform type of LED strip lamp, the first and second lamp housings 10, 20 generally have the same structure, especially a cross-sectional structure. Of course, in some special cases, it is conceivable that the first and second lamp housings 10, 20 may also have different cross-sectional configurations. In this embodiment, the first and second lamp housings 10, 20 have the same structure and are tubular structures. The light emitting module, the light distribution module, the circuit module and the like are housed in the first and second lamp housings 10 and 20 of the tubular structure. The first and second lamp housings 10 and 20 may be made of metal material to facilitate heat dissipation while their radial size can be very small, for example, the maximum diameter is only 1 cm or less.

The socket 20 and the plug 40 are complementary to each other, that is, the socket 20 cooperates with the plug 40 to complete the function of connecting and taking power. Both the socket 20 and the plug 40 may be respectively disposed at the axial ends of the first and second lamp housings 10, 30. When the socket 20 and the plug 40 are plugged together, they may be connected into a strip. The socket 20 comprises a first magnet 21 disposed at an axial end of the first lamp housing 10, a first pad 22 coupled within the first lamp housing 10, a first electrical connector 23 fixed in the first pad 22, a C-shaped clamping spring 24 sandwiched between the first magnet 21 and the first electrical connector 23. The first magnet 21 may be fastened to the end of the first lamp housing 10 by a fastener, which may be a sheet-like structure, and the thickness of the first magnet 21 may be set according to actual needs, such as the weight of the LED strip-shaped lamp. The center of the first magnet 21 has a through hole. The purpose of the through hole is to allow the first and second electrical connectors 23 and 43 to pass the through hole, so as to allow the north and south magnetic lines of the magnet to pass through. When the through-holes are provided, the first and second magnets 21 and 41 are attracted to each other to achieve a high degree of concentricity. That is, the central axes of the first and second magnets 21 and 41 forms a straight line. The first pad 22 is disposed within the first lamp housing 10 and sandwiched between the first magnet 21 and an end of the first lamp housing 10. Therefore, an end of the first lamp housing 10 is provided with a step 11 for disposing the first pad 22, and the first magnet 21 is covered on the first pad 22, that is, the first pad 22 is sandwiched between the first lamp housing 10 and the first magnet 21. The first pad 22 has a first accommodating cavity 221 for disposing the first electrical connector 23. The first electrical connector 23 is fixed in the first accommodating cavity 221 of the first pad 22. The first and second electrical connectors 23, 43 are mating components, and the first and second electrical connectors 23, 24 are selected according to the diameters of the first and second lamp housings 10, 30 in actual use. For example, when the diameters of the first and second lamp housings 10, 30 are larger than two centimeters, the first electrical connector 23 can be a socket hole and the second electrical connector 43 can be a pin. When the first and second magnets 21 and 41 are attracted together, the pin is inserted into the socket hole to establish an electrical connection. It should be known to a person skilled in the art that the pin and the socket hole should be a standard part in the prior art for use and details are not described herein again. Of course, if the diameters of the first and second lamp housings 10, 30 are larger, the other electrical connection standard plugs and sockets may also be selected. In this embodiment, since the diameter of the first and second lamp housings 10 and 30 is only about 1 cm, the volume of the first and second electrical connectors 23 and 43 needs to be designed smaller. In this embodiment, the first electrical connector 23 is a contact piece, and the contact piece is fixed between the C-shaped clamping spring 24 and the first pad 22. The contact piece is electrically connected to the circuit board disposed in the first lamp housing 10 to provide power. In order to set the C-shaped clamping spring 24, the inner diameter of the accommodating cavity 221 of the first pad 22 is larger than the inner diameter of the through hole of the first magnet 21, so that the C-shaped clamping spring 24 can be located between the first pad 22 and the first magnet 21. The C-shaped clamping spring 24 is a fastener standard, which is well known to those skilled in the art and will not be described in detail here.

The plug 40 comprises a second magnet 41 disposed at an end portion of the second lamp housing 30, a second pad 42 coupled within the second lamp housing 30, a second electrical connector 43 fixed to the second pad 42, a spacer ring 44 disposed between the second electrical connector 43 and the second magnet 41. The second magnet 42 has the same structure as the first magnet 41, and a through hole is also formed at the center of the second magnet 42. No further description is provided herein. The second pad 42 and the first pad 41 also have substantially the same structure and are both made of insulating material and the purpose is to fix the second electrical connector 43 and to insulate the second electrical connector 43 and the second lamp housing 30. Since the first electrical connector 23 is a contact piece, the second electrical connector 43 is an elastic contactor. The elastic contact is also a standard component, and comprises a blind barrel 431 closed at one end, an elastic member 432 filled in the blind barrel 431, and a contactor 433 hooked on the open end of the blind barrel 431. The blind cylinder 431 is generally made of metal so that the open end of the blind cylinder 431 can be compressed after the contactor 433 is fitted therein to lock the contactor 433 in the blind cylinder 431. It can be understood that the blind barrel 431 will be electrically connected with the circuit board held in second lamp housing 30. The elastic member 432 may be a spring. The contactor 433 can be a rolling ball or a rotating member with a "convex" cross section. In this embodiment, the contactor 433 is a ball. When the ball is fitted in the blind cylinder 431, the opening end of the blind cylinder 431 is compressed so that the diameter of its opening is smaller than the diameter of the ball. An end of the blind barrel 431 has a flange 434, and the flange 434 is sandwiched between the spacer ring 44 and the second pad 42. The spacer ring 44 is made of insulating material and is used to isolate the second electrical connector 43 and the second magnet 41. The end of the spacer ring 44 comprises a flange ring 441. The flange ring 441 is sandwiched between the flange 434 and the second magnet 41 so as to fix the position of the elastic contactor. Of course, the contactor 433 extends out of the second magnet 41. The first magnet 21 and the second magnet 41 attract each other to connect the first and second lamp housings 10 and 30. When the first and second magnets 21 and 41 are attracted to each other, the first electrical connector 23 and the second electrical connector 43 are coupled together to establish an electrical connection to transmit power. In this embodiment, when the first and second magnets 21 and 41 are attracted together, the attractive force of the first and second magnets 21 and 41 should be larger than the attraction force of the elastic contactor against the contact piece.

Compared with the prior art, the first and second magnets 21 and 41 used in the connecting structure of the LED strip-shaped lamp of the present invention can be used as a structure for connecting the first lamp housing 10 and the second lamp housing 30 so as to simplify the connection of the plurality of strip-shaped lamps. The connecting structure also provides a clamping force for coupling the first electrical connector 23 and the second electrical connector 43. Due to the attractive force of the first and second magnets, the first lamp housing and the second lamp housing can be made to have no mating space without deformation in the connection portion, which may affect the appearance.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. An LED strip-shaped lamp with a connecting structure, comprising:

a first lamp housing, a plug disposed on the first lamp housing, a second lamp housing coupled with the first lamp housing, a socket on the second lamp housing and coupled to the plug; the plug comprising a first magnet disposed at an end of the first lamp housing and a first pad coupled within the first lamp housing, a first electrical connector fixed in the first pad; the first pad sandwiched between the first lamp housing and the first magnet;

the socket comprising a second magnet disposed at an end of the second lamp housing and a second electrical connector fixed in the second pad, a second electrical connector fixed in the second pad; the second pad sandwiched between the second lamp housing and the second magnet;

the first magnet and the second magnet attracting each other to couple the first lamp housing and the second lamp housing; when the first and second magnets are coupled, the first electrical connector and the second electrical connector being coupled to each other to connect electrically.

2. The LED strip-shaped lamp with a connecting structure as claimed in claim 1, wherein the first electrical connector is a contact piece, the second electrical connector is a elastic contactor, attraction force of the first and second magnets is greater than elastic force of the elastic contactor against the contact piece.

3. The LED strip-shaped lamp with a connecting structure as claimed in claim 2, wherein the LED strip-shaped lamp comprises two circuit boards respectively disposed in the first lamp housing and the second lamp housing, and the two circuit boards are respectively electrically connected with the contact piece and the elastic contactor.

4. The LED strip-shaped lamp with a connecting structure as claimed in claim 2, wherein the elastic contactor comprises a blind barrel closed at one end, an elastic member filled in the blind barrel, and a contactor hooked on the open end of the blind barrel.

5. The LED strip-shaped lamp with a connecting structure as claimed in claim 4, wherein the elastic contactor is made of a conductive material, the socket further comprises a spacer ring disposed between the elastic contactor and the second magnet, the spacer ring is made of insulating material.

6. The LED strip-shaped lamp with a connecting structure as claimed in claim 5, wherein an end of the blind barrel has a flange, the flange is sandwiched between the spacer ring and the second pad, and an end of the spacer ring comprises a flange ring sandwiched between the flange and the second magnet.

7. The LED strip-shaped lamp with a connecting structure as claimed in claim 2, wherein the plug further comprises a C-shaped clamping spring sandwiched between the first magnet and the contact piece to fix the relative position between the contact piece and the first pad.

8. The LED strip-shaped lamp with a connecting structure as claimed in claim 1, wherein cross-sectional shapes of the first and second magnets respectively are the same as that of the first lamp housing and the second lamp housing, and the first and second magnets respectively open a through hole along the central axis to facilitate passing the magnetic flux.

9. The LED strip-shaped lamp with a connecting structure as claimed in claim 1, wherein the first electrical connector is a socket hole, the second electrical connector is a pin, when the first and second magnets are coupled together, the pin is inserted in the socket hole to establish electrical connections.

10. The LED strip-shaped lamp with a connecting structure as claimed in claim 1, wherein the first and second pads are made of insulating material.

* * * * *